US006565281B2

(12) United States Patent
Bruns et al.

(10) Patent No.: US 6,565,281 B2
(45) Date of Patent: May 20, 2003

(54) DEVICE FOR PAVING ROADWAYS AND DEVICE FOR PRODUCING FOAMED BITUMEN

(75) Inventors: Thomas Bruns, Buchholz (DE); Walter Grueber, Neustadt (DE); Siegbert Dittmann, Vettelschoss (DE)

(73) Assignee: Wirtgen GmbH, Windhagen (DE)

( * ) Notice: Subject to any disclaimer, the term of this patent is extended or adjusted under 35 U.S.C. 154(b) by 0 days.

(21) Appl. No.: 09/367,041

(22) PCT Filed: Jul. 30, 1997

(86) PCT No.: PCT/EP97/04143

§ 371 (c)(1),
(2), (4) Date: Aug. 6, 1999

(87) PCT Pub. No.: WO98/35102

PCT Pub. Date: Aug. 13, 1998

(65) Prior Publication Data

US 2001/0022919 A1 Sep. 20, 2001

(30) Foreign Application Priority Data

Feb. 8, 1997 (DE) ..... 297 02 162

(51) Int. Cl.[7] ..... E01C 23/088

(52) U.S. Cl. ..... 404/90; 404/92; 239/118; 239/578

(58) Field of Search ..... 239/422, 114–118, 239/104, 106, 123, 368, 419.5, 578, 569; 404/90, 91, 92, 111

(56) References Cited

U.S. PATENT DOCUMENTS

| | | | | |
|---|---|---|---|---|
| 1,979,135 A | * | 10/1934 | Altenburger | |
| 2,290,720 A | * | 7/1942 | Watson | |
| 3,322,350 A | * | 5/1967 | Heinicke et al. | 239/172 |
| 3,612,356 A | * | 10/1971 | McVey | 222/145 |
| 3,672,507 A | * | 6/1972 | Paull, Jr. | 210/77 |
| 3,725,315 A | * | 4/1973 | Bauer | 260/2.5 B |
| 4,204,557 A | * | 5/1980 | Scragg | 137/244 |
| 4,480,789 A | * | 11/1984 | Kemper | 239/116 |
| 4,592,507 A | * | 6/1986 | Benedict | 239/172 |
| 4,637,753 A | * | 1/1987 | Swisher, Jr. | 404/90 |
| 4,692,350 A | * | 9/1987 | Clarke et al. | 427/138 |
| 4,737,524 A | * | 4/1988 | Ako et al. | 521/101 |
| 4,767,060 A | * | 8/1988 | Shay et al. | 239/401 |
| 4,793,734 A | * | 12/1988 | Shook et al. | 404/90 |
| 5,119,991 A | * | 6/1992 | Divers | 239/117 |
| 5,143,345 A | * | 9/1992 | Miki et al. | 251/129.02 |
| 5,354,147 A | * | 10/1994 | Swisher, Jr. | 404/90 |
| 5,366,308 A | * | 11/1994 | Crispino | 401/1 |
| 5,401,312 A | * | 3/1995 | Hanst | 404/90 |
| 5,413,308 A | * | 5/1995 | Hayes | 251/77 |
| 5,486,554 A | * | 1/1996 | Truax | 524/71 |
| 5,584,597 A | * | 12/1996 | Lemelson | 404/111 |
| 5,827,360 A | * | 10/1998 | Salminen | 106/273.1 |

FOREIGN PATENT DOCUMENTS

| | | | | |
|---|---|---|---|---|
| FI | WO 95/22661 | * | 8/1995 | E01C/19/16 |

* cited by examiner

*Primary Examiner*—Thomas B. Will
*Assistant Examiner*—Raymond W Addie
(74) *Attorney, Agent, or Firm*—Diller, Ramik & Wight

(57) ABSTRACT

A device for working road surfaces comprising an automotive running gear (2) with a working roll (4) enclosed by a cover (8) forming a working chamber (6), and a drive motor for providing the power required for driving the working roll (4) and the travel, it is provided that a plurality of adjacent mixing components with foam outlet nozzles (14) for producing foamed bitumen are arranged in an upper portion of the cover (8), hot bitumen supplied from a bitumen reservoir via supply lines (16, 42) and a bitumen injection nozzle (18) together with water supplied from a water reservoir via a water injection nozzle (22) may be mixed under pressure in an expansion chamber (26) of the mixing components, and that the spray jet of foamed bitumen leaving the foam outlet nozzles (14) is directed into the working chamber (6) and becomes mixed into the construction material mixture granulated by the working roll (4).

15 Claims, 2 Drawing Sheets

DEVICE FOR PAVING ROADWAYS AND DEVICE FOR PRODUCING FOAMED BITUMEN

BACKGROUND OF THE INVENTION

The invention refers to a device for working road surfaces according to the precharacterising part of claim 1, as well as a device for producing foamed bitumen for road machines according to the precharacterising part of claim 2.

Such devices are used, for example, in recycling machines for road construction. A road machine, in which the invention may be employed, is described in WO 96/24725, for example.

A device for producing foamed bitumen for road machines, comprising at least one mixing means having at least one expansion chamber, in which mixing means hot bitumen at a temperature of 180° C. and water may be brought together via injection nozzles, is known from WO 95/22661. The device further comprises a heatable foaming reactor, as well as heatable supply and distributing lines, which lines may further be insulated. A plurality of nozzles are arranged side by side along a distributing line. A network of lines connects this distributing line to a central foaming reactor in which the bitumen foam is produced for all nozzles. Further, an agitating unit is provided in this foam reactor. It is a disadvantage of the known device that the bitumen foam has to go a long way from the expansion chamber to the nozzles. As a result, the foam decomposes partly on the way to the nozzles so that an exact dosing of the foamed bitumen is not possible, either. It is another problem that the known device is heated only partly and that in particular the nozzles are not heated. As a consequence, the cleaning of the apparatus is rather time-consuming. Since the cleaning is done with Diesel fuel, this additionally gives rise to a problem in disposing the contaminated fuel.

SUMMARY OF THE INVENTION

It is an object of the present invention to provide a device for working road surfaces, as well as a device for producing foamed bitumen for road working machines that allows for an exact dosing of the foamed bitumen and by which the cleaning and maintenance efforts are reduced to a minimum.

The object is solved with the features of claims 1 and 2.

Advantageously, the invention provides that in a device for working road surfaces, a means for producing foamed bitumen comprising a plurality of adjacent mixing means with foam outlet nozzles is arranged at the cover of the working roll so that the sprayed jet of foamed bitumen leaving the foam outlet nozzles is directed into the working chamber of the working roll and becomes mixed into the mixture of construction material granulated by the working roll. The hot bitumen is supplied from a bitumen reservoir via supply lines and a bitumen injection nozzle and is mixed in an expansion chamber of the mixing means with water supplied from a water reservoir via a water injection nozzle.

Injecting the foamed bitumen directly into the working chamber of the working roll is advantageous in that the foamed bitumen can be mixed directly into the granulated mixture of construction material, before the foam decomposes. The foamed bitumen is produced in a mixing means only shortly before it leaves the foam outlet nozzles, a separate mixing means being provided for each foam outlet nozzle. Producing foamed bitumen only just before it leaves from the foam outlet nozzles advantageously allows for an exact dosing of the foamed bitumen.

In the device for producing foamed bitumen, it is advantageously provided that the injection nozzle for hot bitumen has a plunger for the nozzle opening, which is adapted to the cross-sectional area of the nozzle and may be driven through a control to periodically clean or close the nozzle opening. For cleaning the nozzle, the plunger is pushed through the nozzle 1 to 2 times per minute so that the cross section of the nozzle is always kept free. When the nozzle is to be closed, the plunger remains in the cross section of the nozzle. Every nozzle may be addressed individually so that the working width may be selected, e.g., when passing over a road surface several times.

Further, in a device for producing foamed bitumen, it is provided that a microprocessor control controls the flow quantities of hot bitumen and water as a function of the advancement speed of the road machine. In this manner it is made sure that the dosing is effected with high precision and as a function of the traveling speed and that the ratio between foamed bitumen and granulated construction material is maintained constant.

In a preferred embodiment, it is provided that the water reservoir is provided on the running gear. It is an advantage of a water reservoir provided on the running gear that no separate water supply is required. The water in the water reservoir may also be used for other jobs, such as humidifying the ground, when compacting a road surface.

Preferably, it is provided that air may be blown additionally into the expansion chamber of each mixing means. An additional injection of air increases the forming of foam and allows for an expansion of the foamed bitumen to about 20 times the original volume. In an advantageous development, a mixing means with a foam outlet nozzle that may be separately switched on manually, the mixing means projecting laterally beyond the working roll. This additional foam outlet nozzle is intended for checking the quality of the foam at the beginning of the operation or during the operation of the road machine.

Preferably, the expansion chamber is circular in cross section, the bitumen injection nozzle being arranged coaxial with respect to the expansion chamber. The injection means or the blow means for the water and/or the air eject water or air radially or tangentially into the free jet of the hot foamed bitumen leaving the bitumen injection nozzle. This causes a strong turbulence in the expansion chamber, whereby an optimum foam quality may be obtained.

Preferably, the expansion chamber has an eccentrically arranged foam outlet nozzle. Such an eccentrically arranged nozzle increases the churning of the foamed bitumen and allows for a higher expansion coefficient and a longer half-life of the foam.

The mixing means may be heated by heating means (H). The heating is performed by thermostat-controlled heating means (H) that keep up the optimum working temperature prior to and during the operation, even in case of interruptions. A troublesome rinsing of the mixing means with the foam outlet nozzles can be omitted at the end of the working cycle.

The generator for generating the heating current generates the full heating voltage already when the drive motor is at idle and keeps the same constant even at higher numbers of rotations of the drive motor.

To this end, the generator has a hydraulic drive that may be adjusted to a constant rotational speed of the drive motor by means of a current control valve.

Further advantageous features are evident from the remaining subclaims.

The following is a detailed description of an embodiment of the invention taken in conjunction with the accompanying drawings.

DESCRIPTION OF THE PREFERRED EMBODIMENTS

Figure 1:
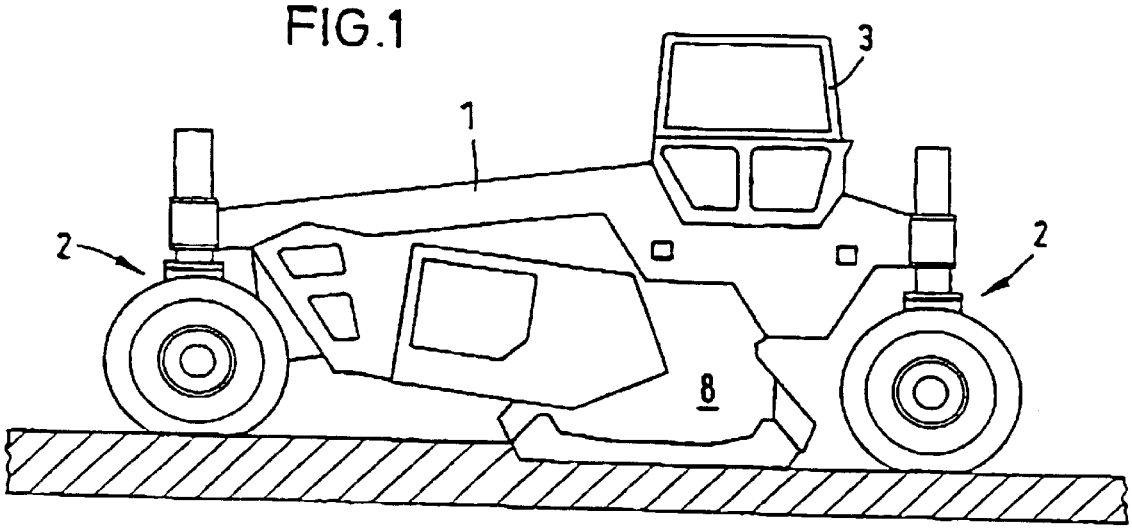
FIG. 1 illustrates a road machine.

FIG. 1 illustrates the device for working road surfaces comprising a machine frame 1 supported by two running gears 2 and a driver's stand consisting of a driver's cabin 3.

At the front and rear ends of the machine frame 1, the running gears 2 have two running gear axes selectively steerable in common or individually.

Below the machine frame 1, a working roll 4 is provided under a cover 8 defining the working chamber 6 of the working roll 4 upwardly and laterally.

The cover 8 connected to the machine frame 1 comprises pulverizer bars 19 pivotable about an axis parallel to the roll axis of the working roll 4. A detailed description of the road machine illustrated in FIG. 1 is given in WO 96/24725.

In its upper portion, the cover 8 has a means 10 for producing foamed bitumen. To produce foamed bitumen, bitumen with a temperature of about 180° C. is mixed with cold water. Thus, the bitumen is foamed, the initial volume of the components increasing by about 20 times.

Due to the foaming process that may be supported by blowing in air, the viscosity of the bitumen is reduced largely. Because of the substantially enlarged volume, the foamed bitumen may be uniformly injected into the working chamber 6 via a plurality of foam outlet nozzles 14 arranged in parallel to the axis of the working roll 4, whereby the foamed bitumen may be mixed into the granulated construction material mixture.

In detail, the means 10 for producing foamed bitumen comprises, e.g., 16 adjacent mixing means 12 interconnected by a common supply line 16, 42 for hot bitumen. The mixing means 12 have a bitumen injection nozzle 18 injecting a free jet of bitumen into an expansion chamber 26 when in the open state. Orthogonal to this free jet and radially or tangentially to the expansion chamber 26 of circular cross section, water is injected via a water injection nozzle 22 and air is injected via an air injection nozzle 29. In the expansion chamber 26, this causes a strong turbulence in the expanding foam volume, whereby a high expansion coefficient of the foamed bitumen and a longer half-life may be achieved. For example, air is blown in at a pressure of 4 to 5 bar.

The foam outlet nozzle 14 is arranged eccentrically to the expansion chamber 26 and to the bitumen injection nozzle 18, whereby the turbulence in the expansion chamber 26 is even intensified.

The bitumen injection nozzle 18 is pulsed to be periodically cleaned using a plunger 30 which is driven by a pneumatic drive means 32 under control by a microprocessor 36. The plunger 30 may also be used to shut off the bitumen injection nozzle 18 if, e.g., the foamed bitumen is to be sprayed over a reduced width. This is feasible, for example, in overlapping works on multiple lanes.

Figure 2:
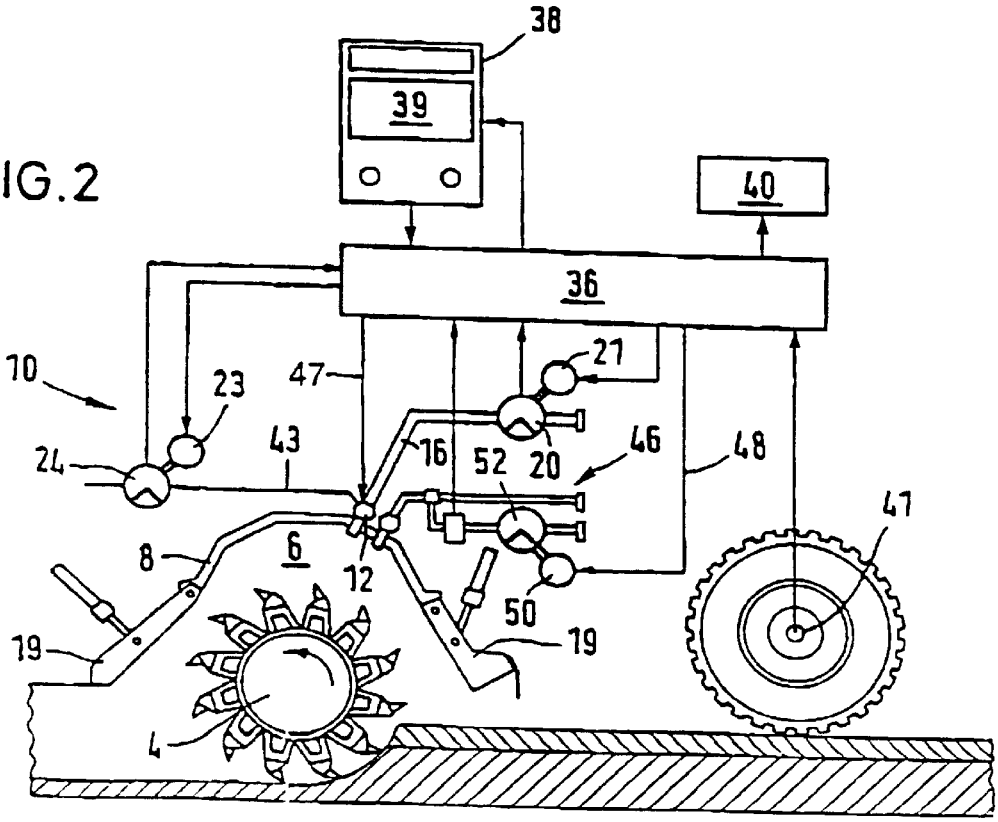
FIG. 2 is a schematic illustration of the microprocessor control for the foam production process.

FIG. 2 is a schematic representation of the microprocessor control for controlling the foam production process and the added amounts, as well as the dosing of the foamed bitumen.

The microprocessor 36 is connected to an electronic input/output unit 38 having a display 39. At the input/output unit 38, one may set the amount of bitumen to be added in percent by weight and the amount of water to be added for the foaming process in percent of the amount of bitumen. Further, the spraying width for overlapping working may be set, i.e., individual foam outlet nozzles 14 may be turned off, if desired. All data on operation and work are displayed on the display 39. The microprocessor 36 is further connected to a printer 40 printing the work data for documentation. Via a wheel sensor 41, the microprocessor 36 is supplied with a signal proportional to the traveling speed of the machine so that the components of the foamed bitumen can be performed as a function of the traveling speed. The microprocessor 36 generates a control signal for the drive motors 21, 23 of a bitumen suction pump 20 for bitumen, as well as for a water suction pump 24, respectively. The effective added amounts of bitumen and water are fed back to the microprocessor 36 by the pumps 20 and 24, respectively for control purposes.

Moreover, the pulsed cleaning of the nozzles in each mixing means 12 is controlled via a signal line 37.

Besides the means 10 for producing foamed bitumen, a means 46 for supplying a suspension of water and cement may be provided, as illustrated in FIG. 2, which may be arranged at the cover 8 in parallel to the means 10 for producing foamed bitumen. Via a signal line 48, a drive motor 50 of a suction pump 52 of the means 46 for supplying a the suspension of water and cement is driven.

Figure 3:
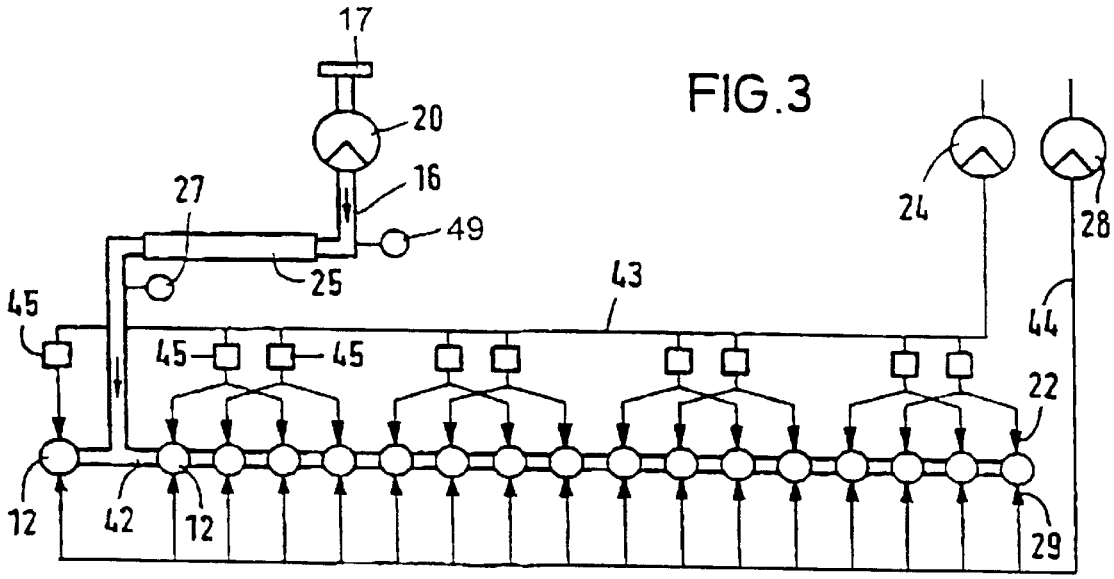
FIG. 3 shows the flow scheme of the foamed bitumen components.

FIG. 3 explains the bringing together of bitumen, water and air in the mixing means 12. The connector 17 for the supply of hot bitumen is supplied with hot bitumen from a bitumen reservoir on the running gear 2. The suction pump 20 for bitumen is controlled by the microprocessor 36, as mentioned before. A temperature sensor 49 controls the temperature of the hot bitumen in the supply line 16. The hot bitumen is filtered in a bitumen filter 25. Downstream the bitumen filter 25, there is a pressure sensor 27 for controlling the working pressure. The supply line 16 opens into a distributing line 42 that may also be designed as a closed circular pipeline so that bitumen not needed may be returned into the bitumen reservoir.

Through the water suction pump 24, drawing water from a water reservoir on the running gear 2, water is supplied to the water injection nozzles 22 via a water supply line 43 and a respective water valve 45 for two mixing means 12. It may be provided that a respective water valve 45 supplies two non-adjacent mixing means 12.

Compressed air is fed from a compressor 28 via an air supply line 44 and the air injection nozzle 29 with a pressure of 4 to 5 bar, for example.

Spaced laterally from the 16, for example, adjacent mixing means 12 disposed along the distributing/closed circular pipeline 42 for hot bitumen, a separate mixing means 12 may be provided such that it protrudes laterally beyond the working roll 4. This further mixing means is used as a test nozzle so as to check the quality of the foam at the beginning of the operation or during the same. This test nozzle may be separately driven manually.

Figure 4:
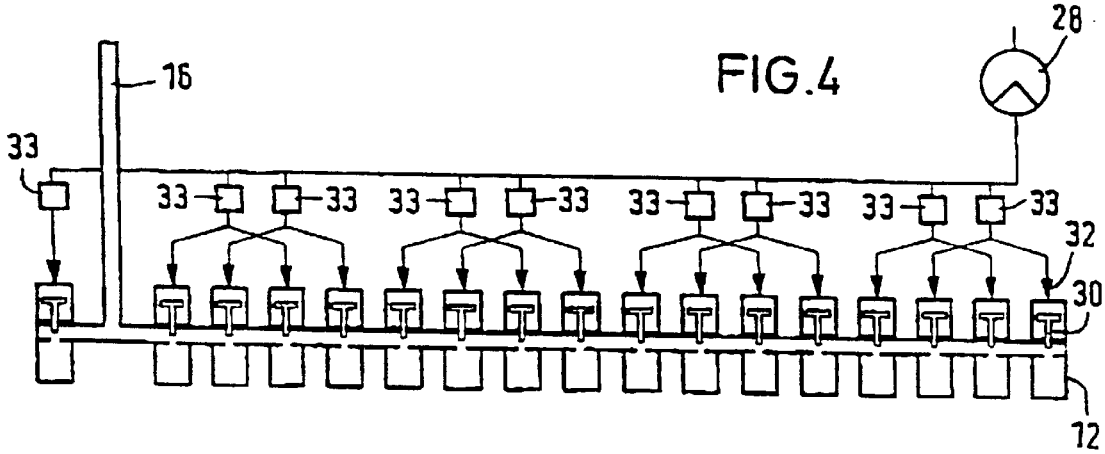
FIG. 4 illustrates the plunger control.
Figure 5:
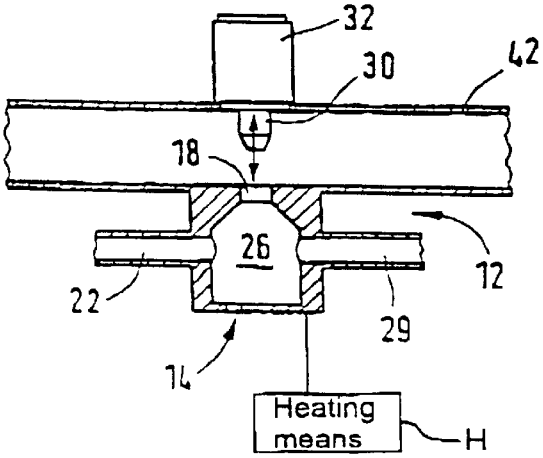
FIG. 5 shows a mixing means.

Further, in FIG. 4, compressed air for the cleaning of the bitumen injection nozzle is branched off from the same compressor 28 or another compressor. Via pneumatic valves 33, the compressed air is supplied to the pneumatic drive means 32 for the plungers 30. During the same cycle also the bitumen injection nozzle 18 of the test nozzle is cleaned.

The bitumen suction pump 20, the supply lines 26, as well as the distributing and closed circular line 42 and the mixing means themselves, in particular the bitumen injection nozzle 18, are provided with heating elements and temperature sensors. The temperature sensors supply a temperature signal to the microprocessor 36 or a thermostatic control. The suction pump for bitumen, the supply lines 16, 42 and the mixing means 12 are further insulated by thick walls to reduce heat losses and to optimize the maintenance of the optimum processing temperature.

A current generator is driven by means of a hydraulic motor. The hydraulic motor for the generator receives its driving energy from a hydraulic pump coupled to the internal combustion engine of the road machine. Even when the internal combustion engine is at idle, the hydraulic motor generates sufficient energy to heat the means 10 for producing foamed bitumen.

Using a current control valve, the rotational speed of the hydraulic motor of the current generator is maintained constant.

The means 10 for producing foamed bitumen, which is controlled by the microprocessor, makes it possible to perform all operations and to preselect the amounts of hot bitumen, water and air to be added, as well as the parameters relevant to the job to be done, from the driver's stand 3.

The control by the microprocessor further allows for a control of the amounts to be added proportional to the traveling speed.

Setting the exact temperature in connection with the periodic cleaning of the bitumen injection nozzle guarantees a high dosing accuracy and functional reliability. A troublesome rinsing of the means 10 for producing foamed bitumen may be omitted at the end of a working cycle.

Although a preferred embodiment of the invention has been specifically illustrated and described herein, it is to be understood that minor variations may be made in the apparatus without departing from the spirit and scope of the invention, as defined the appended claims.

What is claimed is:

1. A device for working road surfaces comprising:

an automotive running gear (2) with a working roll (4) enclosed by a cover (8) forming a working chamber (6);

a drive motor for driving the working roll (4);

means (10) for producing foamed bitumen through a plurality of adjacent mixing means (12) located in the cover (8);

a bitumen reservoir for supplying hot bitumen to said mixing means (12) via a conduit means (42);

said mixing means (12) including means (26) for defining an expansion chamber exterior of said conduit means (42);

aperture means (18) for placing said conduit means (42) in fluid communication with said expansion chamber defining means (26);

foam outlet nozzle means (14) for discharging the foamed bitumen from said expansion chamber defining means (26);

means (22 or 29) for introducing a second fluid into said expansion chamber defining means (26) for admixture with the hot bitumen to thereby form the foamed bitumen incident to the discharge thereof through said foam outlet nozzle means (14);

means (30) for plunging through said aperture means (18) for the cleaning, opening and closing of said aperture means (18), said plunging means (30) being located exteriorly of and substantially coaxially aligned with said aperture means (18), said plunging means (30) and said aperture means (18) being of substantially identical symmetrical cross-sections so that respective exterior and interior complementary surfaces slide axially relative to each other when said plunging means (30) is moved through said aperture means (18) into and out of said expansion chamber defining means (26);

means (32) exteriorly of said conduit means (42) for selectively controlling the movement of said plunging means (30) through said aperture means (18) and into and out of said expansion chamber defining means (26);

said plunging means (30) and aperture means (18) include an associated common axis of movement and flow respectively;

a water reservoir for supplying water to said mixing means (12) via said one second fluid injection means (22) for mixing with the hot bitumen under pressure in said expansion chamber defining means (26);

heating means (H) for heating the mixing means (12); and said foam outlet nozzle means (14) being directed into the working chamber (6) for spraying a jet of the foamed bitumen into and for becoming mixed with a construction material mixture granulated by the working roll (4).

2. The device for working road surfaces as defined in claim 1 wherein said selectively controlling means (32) and said expansion chamber defining means (26) are located at substantially diametrically opposite sides of said first conduit means (42).

3. The device for working road surfaces as defined in claim 1 wherein said foam outlet nozzle means (14) includes a discharge axis arranged parallel to but eccentric of said common axis of said plunging means (30) and said aperture means (18).

4. The device for working road surfaces as defined in claim 1 wherein said one second fluid introducing means (22) injects the second fluid in at least one of a radial and a tangential direction relative to a free jet of the hot bitumen entering said expansion chamber defining means (26) through said aperture means (18) along said common axis.

5. The device for working road surfaces as defined in claim 1 including means (22 or 29) for introducing a third fluid into said expansion chamber defining means (26) for admixing with the hot bitumen to thereby form the foamed bitumen incident to the discharge thereof through said foam outlet nozzle means (14).

6. The device for working road surfaces as defined in claim 2 including means (22 or 29) for introducing a third fluid into said expansion chamber defining means (26) for admixing with the hot bitumen to thereby form the foamed bitumen incident to the discharge thereof through said foam outlet nozzle means (14).

7. The device for working road surfaces as defined in claim 3 including means (22 or 29) for introducing a third fluid into said expansion chamber defining means (26) for admixing with the hot bitumen to thereby form the foamed bitumen incident to the discharge thereof through said foam outlet nozzle means (14).

8. The device for working road surfaces as defined in claim 4 including means (22 or 29) for introducing a third fluid into said expansion chamber defining means (26) for admixing with the hot bitumen to thereby form the foamed bitumen incident to the discharge thereof through said foam outlet nozzle means (14).

9. The device for working road surfaces as defined in claim 5 wherein said second and third fluid introducing means (22 and 29) introduce respective fluids through respective openings opening into said expansion chamber defining means (26) in substantially diametrically opposed relationship.

10. The device for working road surfaces as defined in claim 5 wherein said second and third fluid introducing means (22 and 29) introduce respective fluids through respective openings opening into said expansion chamber defining means (26) along axes lying substantially in a common plane.

11. A device for working road surfaces comprising:

a working roll (4) enclosed by a cover (8) forming a working chamber (6);

means for driving the working roll (4);

means (10) for producing foamed bitumen through a plurality of adjacent mixing means (12) located in the cover (8);

means for supplying hot bitumen to said mixing means (12) via a conduit means (42);

said mixing means (12) including means (26) for defining an expansion chamber exterior of said conduit means (42);

aperture means (18) for placing said conduit means (42) in fluid communication with said expansion chamber defining means (26);

foam outlet nozzle means (14) for discharging the foamed bitumen from said expansion chamber defining means (26); and means (22 or 29) for introducing a second fluid into said expansion chamber defining means (26) for admixture with the hot bitumen to thereby form the foamed bitumen incident to the discharge thereof through said foam outlet nozzle means (14);

means (30) for plunging through said aperture means (18) for the cleaning, opening and closing of said aperture means (18), said plunging means (30) being located exteriorly of and substantially coaxially aligned with said aperture means (18), said plunging means (30) and said aperture means (18) being of substantially identical symmetrical cross-sections so that respective exterior and interior complementary surfaces slide axially relative to each other when said plunging means (30) is moved through said aperture means (18) into and out of said expansion chamber defining means (26);

means (32) for selectively controlling the movement of said plunging means (30) through said aperture means (18) and into and out of said expansion chamber defining means (26);

said plunging means (30) and aperture means (18) include an associated common axis of movement and flow respectively;

means for supplying fluid to said mixing means (12) via said one second fluid injection means (22) for mixing with the hot bitumen in said expansion chamber defining means (26); and said foam outlet nozzle means (14) being directed into the working chamber (6) for spraying a jet of the foamed bitumen into and for becoming mixed with a construction material mixture granulated by the working roll (4).

12. The device for working road surfaces as defined in claim 11 including means (22 or 29) for introducing a third fluid into said expansion chamber defining means (26) for admixing with the hot bitumen to thereby form the foamed bitumen incident to the discharge thereof through said foam outlet nozzle means (14).

13. The device for working road surfaces as defined in claim 12 wherein said second and third fluid introducing means (22 and 29) introduce respective fluids through respective openings opening into said expansion chamber defining means (26) in substantially diametrically opposed relationship.

14. The device for working road surfaces as defined in claim 12 wherein said second and third fluid introducing means (22 and 29) introduce respective fluids through respective openings opening into said expansion chamber along axes lying substantially in a common plane.

15. The device for working road surfaces as defined in claim 13 wherein said second and third fluid introducing means (22 and 29) introduce respective fluids through respective openings opening into said expansion chamber along axes lying substantially in a common plane.

* * * * *